US006836921B1

(12) United States Patent
Petner

(10) Patent No.: US 6,836,921 B1
(45) Date of Patent: Jan. 4, 2005

(54) DECK MOP WITH SCRUBBER

(75) Inventor: Robert E. Petner, Burlington, NJ (US)

(73) Assignee: Quickie Manufacturing Corp., Cinnaminson, NJ (US)

( * ) Notice: Subject to any disclaimer, the term of this patent is extended or adjusted under 35 U.S.C. 154(b) by 0 days.

(21) Appl. No.: 10/773,929

(22) Filed: Feb. 6, 2004

(51) Int. Cl.[7] ..... A47L 13/12; A47L 13/20
(52) U.S. Cl. ..... 15/115; 15/147.1; 15/229.2
(58) Field of Search ..... 15/115, 118, 229.1, 15/229.2, 229.6, 147.1

(56) References Cited

U.S. PATENT DOCUMENTS 1,221,606 A * 4/1917 Sadler ..... 401/291
2,304,961 A * 12/1942 Solomon ..... 15/147.1
2,637,867 A * 5/1953 Joseph ..... 15/115
2,683,886 A * 7/1954 Matthew ..... 15/115
3,964,121 A * 6/1976 Kim ..... 15/115
4,604,767 A * 8/1986 Burkhart et al. ..... 15/119.2
4,654,920 A * 4/1987 O'Neil et al. ..... 15/119.2
4,675,932 A * 6/1987 Hofacker, Jr. ..... 15/118
4,964,186 A * 10/1990 Stuck ..... 15/118
5,913,347 A * 6/1999 Wilen ..... 15/115
RE37,415 E * 10/2001 Petner ..... 15/118
2004/0098820 A1 * 5/2004 Williams et al. ..... 15/115

* cited by examiner

*Primary Examiner*—Randall Chin
(74) *Attorney, Agent, or Firm*—Stuart M. Goldstein

(57) ABSTRACT

A deck or swab mop with an elongated handle and absorbent cleaning strands extends from an integrally formed body. The mop body has parallelly aligned front and rear walls and a top wall extending between the front and rear walls. An abrasive scrubber element with a downwardly extending abrasive surface extends from one of the side walls. The abrasive surface can easily and effectively be used to clean ingrained soiled areas.

4 Claims, 3 Drawing Sheets

DECK MOP WITH SCRUBBER

BACKGROUND OF THE INVENTION

Swab or deck mops have been used as popular cleaning tools for many years. Such mops routinely consist of a handle secured to a mop head, from which cloth, cotton, sponge or other absorbent material cleaning strand elements extend. The cleaning strand elements absorb liquid and are also used to apply floor cleaning substances like water, soap, polish, or other fluid for the cleaning, restoration, and preservation of floor surfaces. Despite the relative success of these type mops, they are generally ineffective in removing ingrained soiled areas. For cleaning ingrained dirt and stains, an abrasive surface is required. Such may be accomplished by the use of a separate abrasive component.

Abrasive scrubber components have been used on a variety of different types of mops. As early as the late nineteenth century, brush surfaces were added to mops, as seen in the pivoted press plate sponge shown in U.S. Pat. No. 603,000. Other examples of abrasive brush surfaces on mops of varied configurations include U.S. Pat. No. 2,472,781, showing a brush mounted on a one piece sponge mop; U.S. Pat. No. 4,491,998, disclosing an abrasive scrubber mounted on a roller type sponge mop; and U.S. Pat. No. 5,488,750, which employs a unique abrasive scrubber unit employed on a butterfly sponge mop. There have also been deck mops which have attempted to incorporate an abrasive element. For instance, U.S. Pat. No. 5,875,509 discloses a swab mop with an abrasive element attached to the ends of the mop's cleaning strands. This arrangement suggests several problems in practical use. The cleaning strands obviously get in the way of the abrasive component during the cleaning operation. More fundamentally, it is difficult to effectively clean soil ingrained areas with this mop, as the user would be compelled to apply pressure to the abrasive element while literally holding the mop perpendicular to the cleaning surface, making use of the abrasive feature difficult and impractical. And, while U.S. Pat. No. 6,085,378 shows an effectively placed scrubber element on a swab mop, the element is located on a roller sleeve, and thus can not be used unless employed with the system disclosed in that patent.

SUMMARY OF THE INVENTION

It is thus the object of the present invention to overcome the limitations and disadvantages of prior swab or deck mops.

It is the object of the present invention to increase the versatility of deck mops.

It is another object of the present invention to provide a deck mop which has an abrasive scrubber feature which is easy and simply to use.

It is a further object of the present invention to provide a deck mop which has an abrasive scrubber feature which can be used to effectively and efficiently clean ingrained soil areas.

It is another object of the present invention to provide a deck mop which employs and locates an abrasive scrubber on its mop head to allow ready positioning of the mop to clean ingrained soil areas in an unencumbered manner.

It is yet another object of the present invention to provide a deck mop which allows for increased life of the abrasive scrubber, by employing replaceable abrasive surfaces.

These and other objects are accomplished by the present invention which comprises a deck mop with an elongated handle and absorbent cleaning strands extending from an integrally formed mop body. The mop body has parallelly aligned front and rear walls and a top wall extending between the front and rear walls. An abrasive scrubber element with a downwardly extending abrasive surface extends from one of the side walls. The abrasive surface can easily and effectively be used to clean ingrained soiled areas.

The novel features which are considered as characteristic of the invention are set forth in particular in the appended claims. The invention itself, both as to its design, construction, and use, together with additional features and advantages thereof, are best understood upon review of the following detailed description with reference to the accompanying drawings.

DETAILED DESCRIPTION OF THE INVENTION

Figure 1:
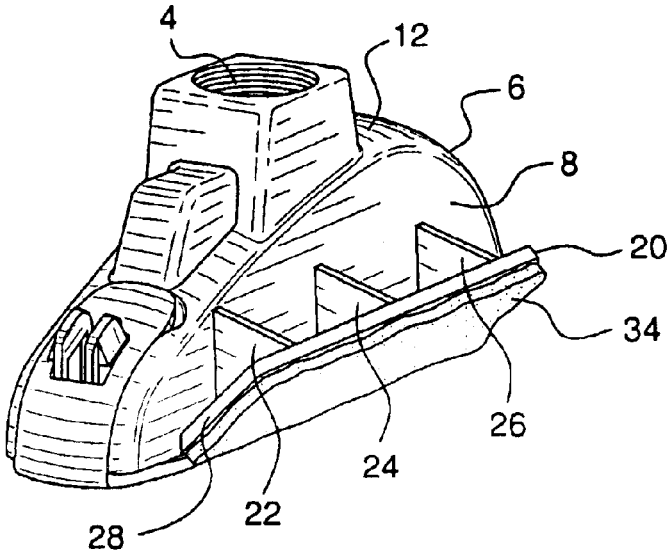
FIG. 1 is a perspective view of the deck mop body with scrubber member attached.
Figure 2:
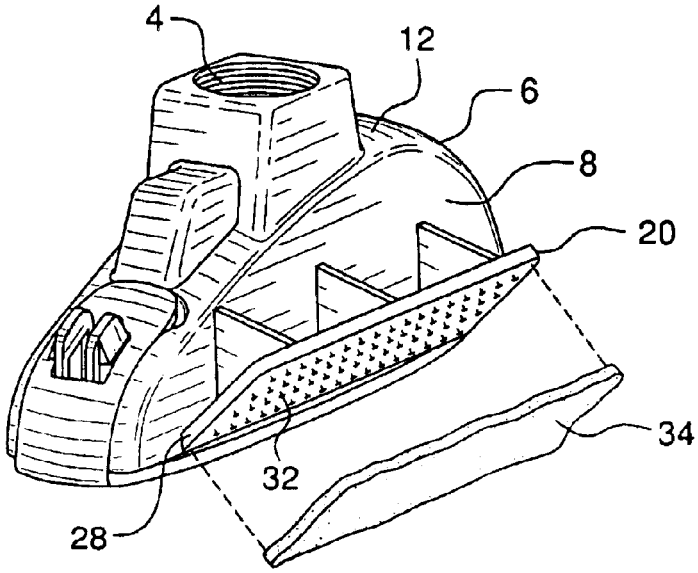
FIG. 2 is a perspective view of the deck mop body separated from the scrubber member.
Figure 3:
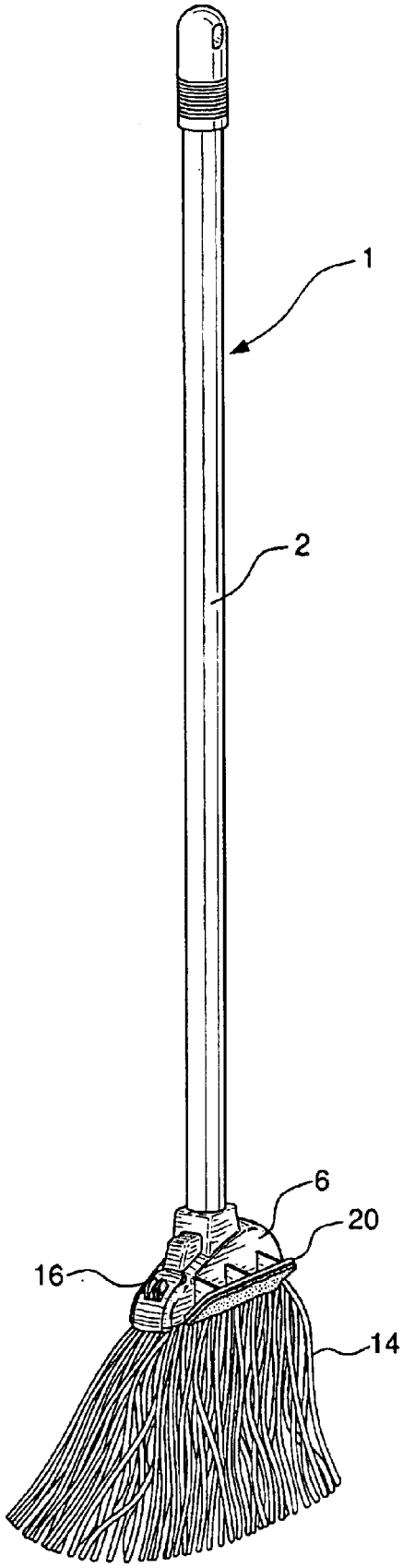
FIG. 3 is a perspective view of the deck mop of the present invention.
Figure 4:
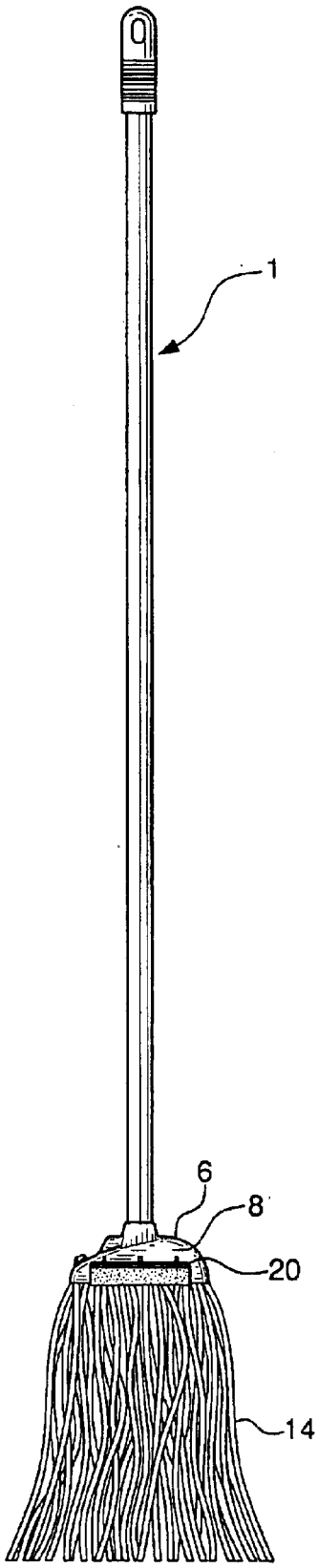
FIG. 4 is a front view of the deck mop of the present invention.
Figure 5:
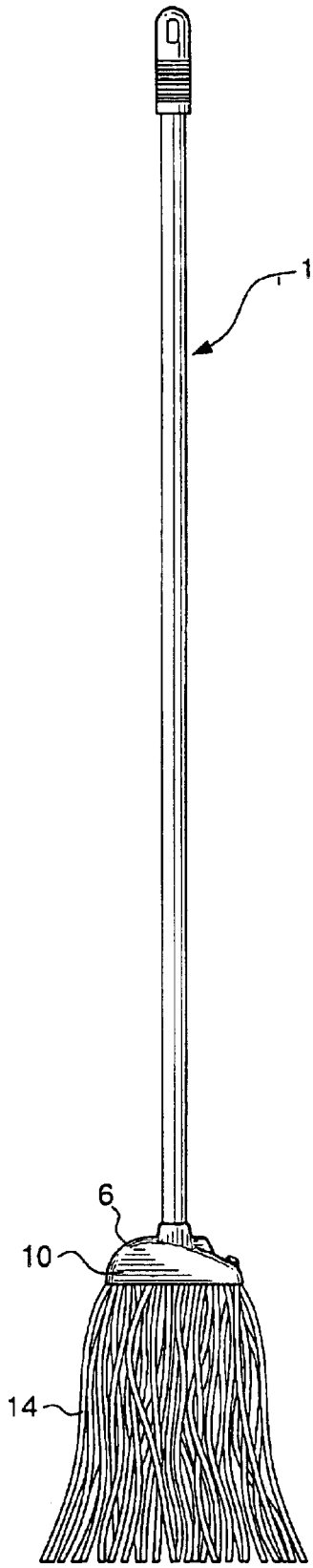
FIG. 5 is a rear view of the deck mop of the present invention.

Mop 1 of the present invention is shown in the drawings in the form of a swab or deck mop with handle 2 secured by threaded connection 4, or similar commonly known means, to mop body 6. Mop body 6 has parallelly aligned front wall 8 and rear wall 10 and, located between and connected to these walls, intervening top wall 12. Top wall 12 supports threaded connection 4. Absorbent material cleaning strand elements 14, made of cloth, cotton, sponge or other absorbent material, extend from mop body 6 and are attached to the mop body by means of attachment component 16, well-known in the art.

Abrasive scrubber element 20 extends from front wall 8. Scrubber element 20 comprises support ribs 22, 24, and 26 which extend between front wall 8 and scrubber body 28. Scrubber body 28 of cleaning element 20 comprises outer surface 32 for attachment to abrasive scrubber member 34. Scrubber member 34 can be an abrasive pad or similar coarse surface which can be permanently attached to outer surface 32 or attached by means of Velcro® or similar means. When secured by Velcro® or similar removable attachments, scrubber member 34 can be replaced when it becomes worn. Scrubber element 20 can also comprise brush-like scrubbing surfaces in scrub brush-like configuration. It is emphasized that the invention is not limited in scope to the type of abrasive scrubber elements which are disclosed herein, nor by the manner of attachment of scrubber member 34 to scrubber body 28. For instance, any adaptable abrasive scrubber element, like a brush or other type of scrubbing pad, can be used.

Mop body 6, with scrubber element 20, can be formed as an integral, unitary element. It is contemplated that it can be made of molded plastic. Mop body 6 and scrubber element 20 can also be made as separate components and secured together. The invention is not to be considered limited in scope to the means of construction and materials used.

Deck mop 1 of the present invention can thus easily and effectively be used to clean ingrained soiled surfaces by simply angling the mop so that scrubber member 34 of scrubber element 20 contacts the surface. Appropriate back and forth pressure can readily be applied via handle 2 to clean the soiled area, without encumbrance or hindrance from strand elements 14.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

What is claimed is:

1. A deck mop comprising:

a. an elongated handle;

b. a unitary mop body with a transverse width and a longer longitudinal length and a plurality of absorbent material strands attached to and extending from the mop body, said mop body comprising receiving means to accept and secure the handle to the mop body, the mop body further comprising a front wall and a rear wall, the walls extending substantially the full longitudinal length of the mop body and being separated by and connected to an intervening top wall which supports the receiving means and which has a uniform transverse width which is substantially the same as the width of the mop body, said top wall traversing the length of the body and extending between the front and rear walls, the front and rear walls extending substantially from the top wall to the strands;

c. scrubber means for cleaning ingrained, soiled surfaces, said scrubber means having an abrasive surface; and d. support means for connecting the scrubber means to the front wall, said support means comprising a plurality of rib means extending outwardly from the front wall and between the front wall and the scrubber means for maintaining the abrasive surface of the scrubber means in a downwardly facing, stationary position in relation to the mop body.

2. The deck mop as in claim 1 in which the front and rear walls are parallelly aligned.

3. The deck mop as in claim 1 in which the abrasive surface is positioned at an oblique angle to the front wall to which it is maintained.

4. The deck mop as in claim 1 wherein the abrasive surface comprises an abrasive pad.

* * * * *